United States Patent [19]

Hsu

[11] Patent Number: 4,984,723

[45] Date of Patent: Jan. 15, 1991

[54] ASSEMBLY OF BEVERAGE BOTTLE/CAN AND CUP

[76] Inventor: Li-Ling Hsu, No. 311, Tun-Hwa North Road, Taipei, Taiwan

[21] Appl. No.: 426,998

[22] Filed: Oct. 26, 1989

[51] Int. Cl.[5] ..... A47G 23/02; B65D 21/00; B65D 23/08

[52] U.S. Cl. ..... 224/148; 224/252; 224/253; 215/10; 215/100 R; 215/DIG. 7; 220/85 H

[58] Field of Search ..... 215/12.1, 13.1, DIG. 7, 215/100 R, 10; 220/903, 85 H, 23.83; 224/148, 252, 253; 206/546, 547, 514, 217

[56] References Cited

U.S. PATENT DOCUMENTS

| | | | |
|---|---|---|---|
| 326,296 | 9/1885 | Johnston | 224/148 |
| 896,903 | 8/1908 | Ferry | 215/DIG. 7 X |
| 2,601,573 | 6/1952 | Venis | 215/12.1 |
| 2,978,132 | 4/1961 | Huck | 215/12.1 |
| 2,989,203 | 6/1961 | Bramming | 215/12.1 |
| 3,257,025 | 6/1966 | Jolly | 220/903 X |
| 4,018,371 | 4/1977 | George | 224/148 |
| 4,450,966 | 5/1984 | Villavicencio, Jr. et al. | 206/547 |
| 4,495,404 | 1/1985 | Carmichael | 206/546 X |
| 4,505,390 | 3/1985 | Kirk, Jr. | 206/547 |
| 4,720,023 | 1/1988 | Jeff | 220/903 X |

*Primary Examiner*—Sue A. Weaver
*Attorney, Agent, or Firm*—Young & Forward

[57] ABSTRACT

An assembly of beverage bottle/can and cup consisting of a beverage bottle or can for containing the beverage and a cup for encasing the lower part of said bottle or can to be integrated as one body, wherein a plurality of parallel linear projections are provided to the inner wall at the upper part of cup whereon a plurality of vent grooves are spaced in a suitable distance in the direction perpendicular to the said projections, and a clip is provided to the outer upper edge of cup; the said assembly provides the consumers with the convenience of pouring the beverage for drinking as they like by taking the advantage of the cup, fixing the bottle or can onto their knapsack bag or girdle optionally by means of the clip, and bringing the beverage bottle or can with them if the beverage therein has not been drunk up.

2 Claims, 5 Drawing Sheets

ASSEMBLY OF BEVERAGE BOTTLE/CAN AND CUP

BACKGROUND OF THE INVENTION:

The conventional bottled or canned beverage is sized according to difference consumer requirements. For instance, the larger beverage bottle with a capacity of over 1,250 ml may be for drinking jointly by two or more persons, and the smaller beverage bottle or the easy-to-open can with a capacity of 350 ml may be for drinking single by an individual. These are designed for the consumption market by the beverage manufacturers. With regard to the manner of drinking, for the said larger beverage bottle, the user has to prepare some cup and pour the beverage into the cup; for the smaller beverage bottle or can, the user may open it and pour the beverage directly into his mouth; this is a fact which remains unchanged for a number of years.

In drinking the beverage from the said bottle or can at home or indoors, when the drinker cannot drink up a whole bottle or can, certainly he may store the surplus beverage therein in an ice box for drinking next time. However, in outdoor circumstances such as the mountain climbing, sightseeing or at the break during visiting, the drinker cannot drink up a whole bottle or can once, he has to hold it with his hand or discard the partially emptied container. Since the drink in general in market is a liquid with the carbonic acid, to drink too much will result in air expansion in the drinker's stomach, which is a disadvantage frequently overlooked by the people at large; no improvement on this disadvantage is available up to now. In addition, to drink the beverage from the bottle or can, the drinker may not always remember to bring a cup with him, so it is very inconvenient for the drinker to drink the beverage in the larger bottle when no cup is available.

In view of the above, it is very inconvenient for the people who are engaged in outdoor mountain climbing and sightseeing to drink the beverage in the said larger bottle or can if they have not brought some cup with themselves, and if they can't drink up a whole bottle or can, they have to hold it with their hand.

SUMMARY OF THE INVENTION

The present invention is related to an assembly of beverage bottle/can and cup in the interest of consumers' drinking in outdoor circumstances.

The present invention is characterized by the following designs: a cup may be engaged with a beverage bottle or can of the lower part which may be inserted into the cup so that the beverage bottle or can and cup are integrated into one body, and a clip is provided to the outer upper edge of said cup so that the said assembly may be optionally fixed onto the knapsack or girdle of its user.

BRIEF DESCRIPTION OF THE DRAWINGS

FIG. 6-1 is an optional view of the cup engaged with a round-bottom beverage bottle.

FIG. 6-2 is an optional view of the cup engaged with a base-added beverage bottle.

FIG. 6-3 is an optional view of the cup engaged with a flat-bottom beverage bottle.

FIG. 6-4 is an optional view of the cup engaged with an easy-to-open beverage can.

DETAILED DESCRIPTION OF THE INVENTION

Figure 1:
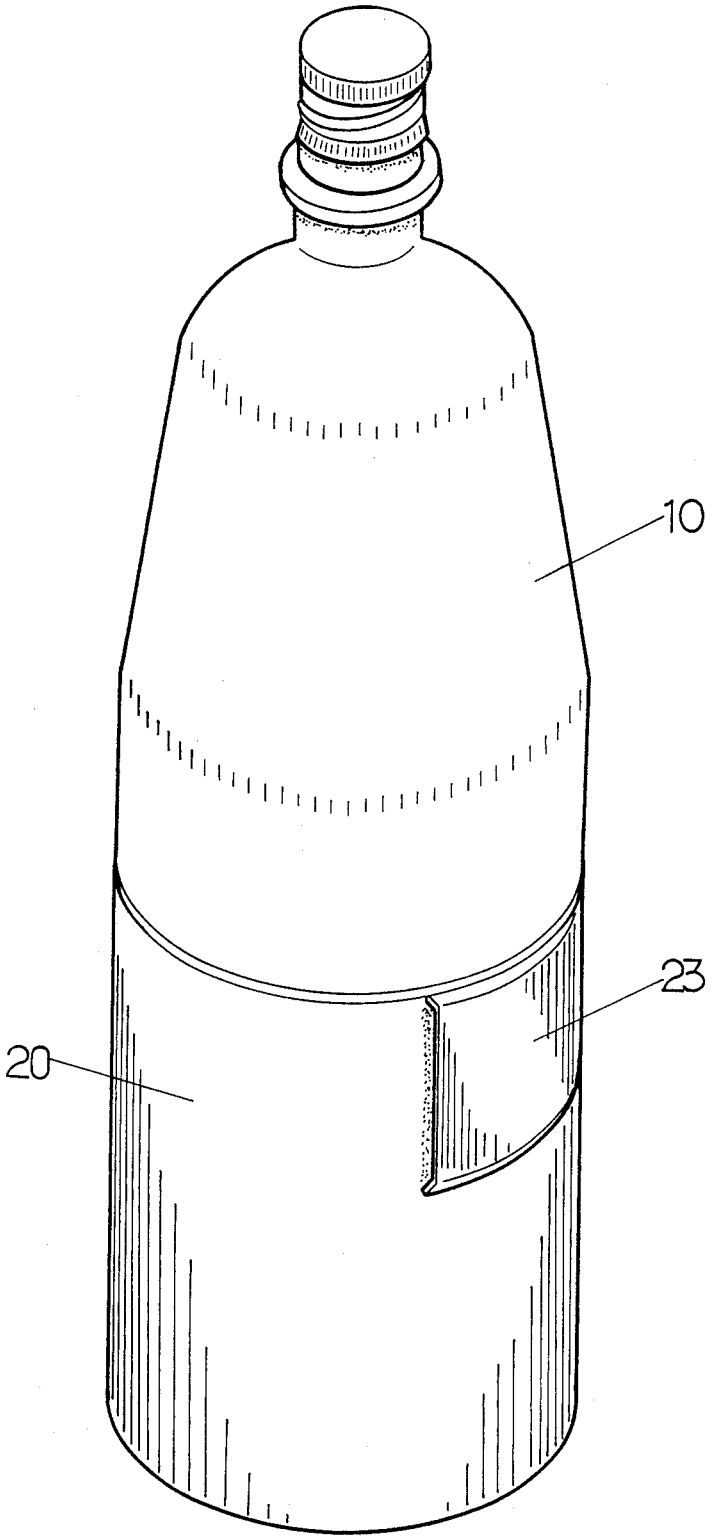
FIG. 1 is an elevational appearance view of the present invention.
Figure 2:
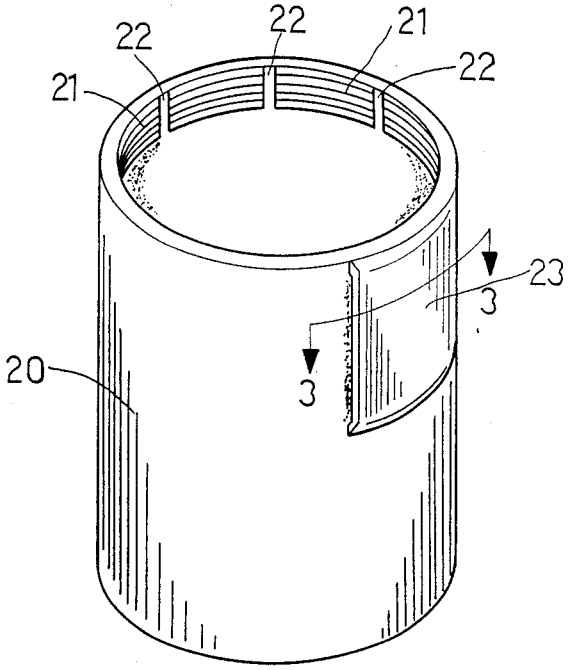
FIG. 2 is an elevational appearance of the cup of the present invention.

As shown in FIG. 1 and FIG. 2, a cup (20) of the present invention is engaged with the lower part of a beverage bottle (10) which can be exactly inserted into the cup (20) and will not disengage therefrom. The cup has an annular cylindrical side wall 24 that defines a cup central axis 25. The user may pour the beverage from the said bottle (10) into the cup (20) for drinking from time to time. A plurality of parallel linear projections (21) extend circumferentially along the inner surface of the cup side wall at the upper part of cup (20) whereon a plurality of vent grooves (22) are spaced in a suitable distance in the direction perpendicular to the said projection (21). These projections (21) and grooves (22) are designed to easily insert the beverage bottle (10) into the cup (20) or disengage the bottle (10) from the cup (20). Otherwise, the bottle (10) inserted into the cup (20) is in an airtight state, such that it is difficult to disengage the bottle (10) from the cup (20).

Figure 4:
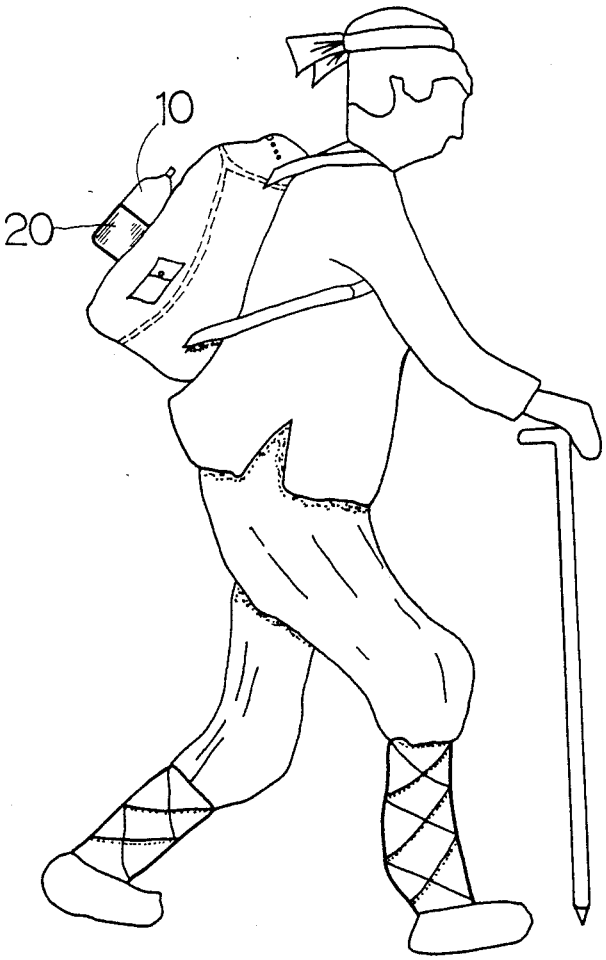
FIG. 4 is an optional view of an example of the present invention for alpinist.

As shown in FIG. 1, 2 and 4, the outer upper edge of said cup (20) is provided with a clip (23) which may support the weight of cup (20), bottle (10) and the contained beverage. Therefore, if the alpinists, tourists, ladies or children cannot drink up the beverage in the bottle (10) at once, the bottle (10) may be fixed onto the canvas bag of knapsack or travelling bag or girdle of users who need not to hold the beverage bottle (10) when going ahead. Use of the clip 23 enables bottle to be stored out of the way so that users can bring the bottle (10) with them without having the bottle affect their taking picture en route, and hugging or holding children during play, nor spoil the alpinists' pleasure of sightseeing and taking care of their security.

Figure 3:
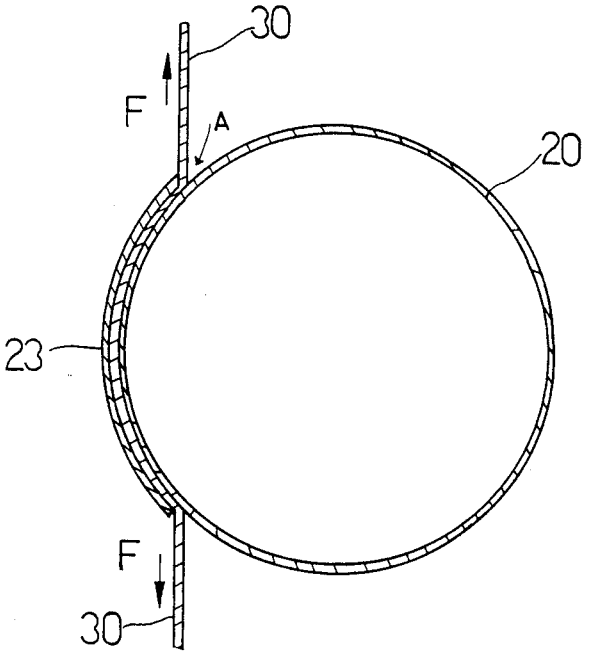
FIG. 3 is an optional section view of fixing the assembly of the present invention by means of a clip taken along the 3—3 line of FIG. 2.

As shown in FIGS. 2, 3 and 4, the said clip (23) extends down along the arc-shaped surface of cup (20), and a concave space (A) is formed between the clip (23) and the wall surface of cup (20). When the clip (23) is inserted into the inner side of canvas bag or travelling bag or girdle, the bag cloth or girdle (30) will generate a binding tension (F) in the said concave (A) so that the clip (23) and the bag cloth or girdle (30) may be kept in a state of insertion and fixing.

Figure 5:
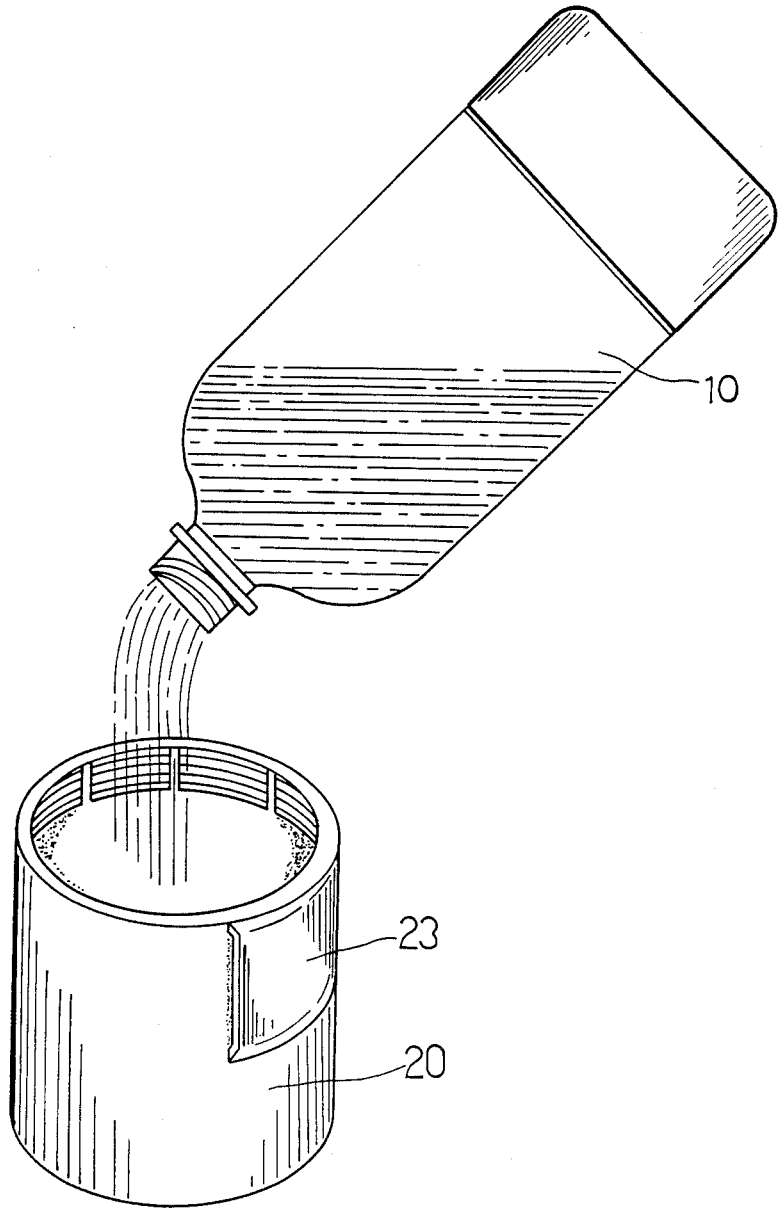
FIG. 5 is an example of using the cup of the present invention.

As shown in FIG. 1 and 5, the beverage bottle (10) and cup (20) of the present invention are usually assembled into one body. When the consumer intends to drink the beverage, he may remove the cup (20) from the bottle (10) so as to pour the beverage into the cup for drinking, and thus has no trouble of bringing a cup. The alpinists may drink the delicious beverage very conveniently from time to time without having to necessarily look for a cup in the wild country.

Figures 1, 2, 3, 4, 6:
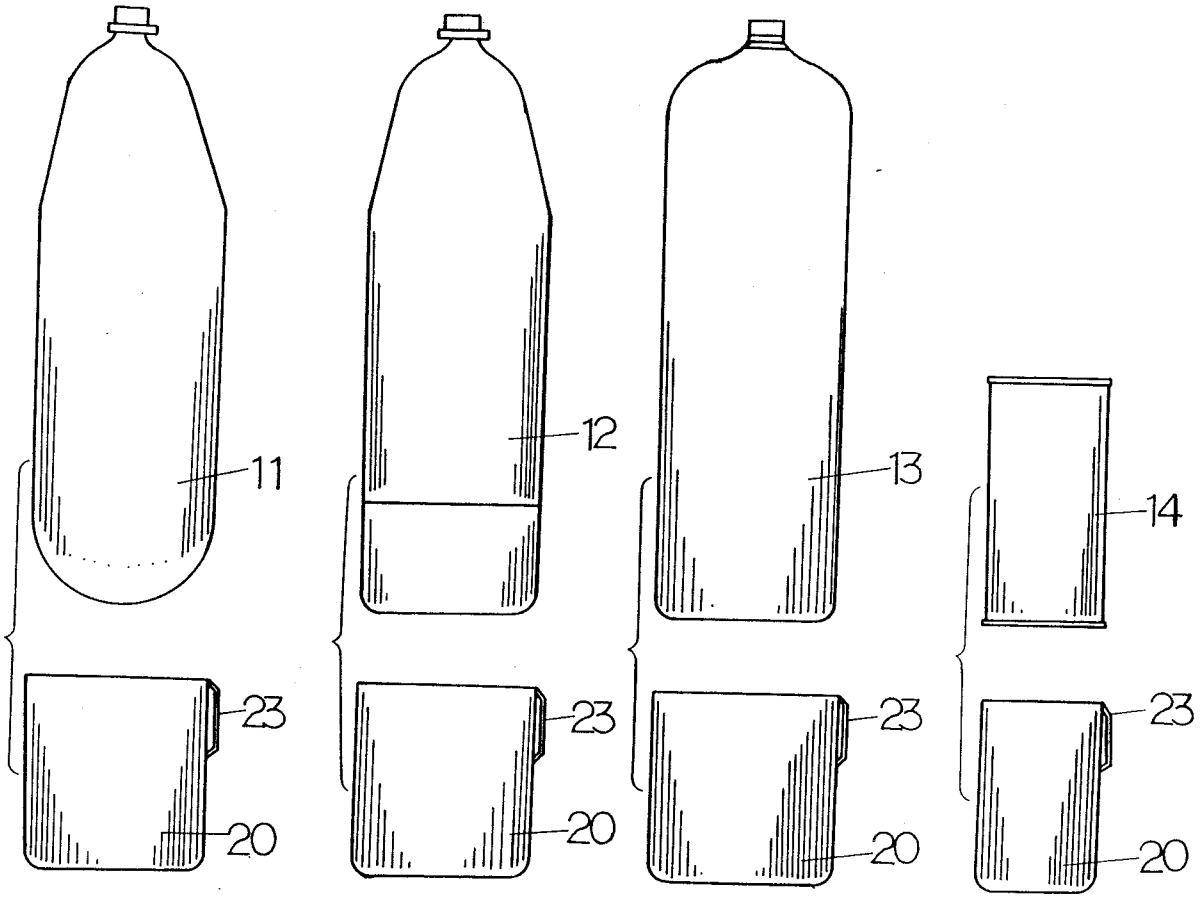

So far as the examples of the present invention are concerned, the cup (20) may be engaged with a round-bottom beverage bottle (11) (as shown in FIG. 6-1), a base-added beverage bottle (12)(as shown in FIG. 6-2), a flat-bottom beverage bottle (13)(as shown in FIG. 6-3)

or an easy-to-open can (14)(as shown in FIG. 6-4). The present invention offers the consumers maximum convenience of having a cup readily available so that they can drink the beverage from time to time, and the surplus drink in the beverage bottle or can may be reserved for drinking next time through fixing the said bottle or can onto the knapsack bag, travelling bag or girdle by means of the clip (23), so that it is unnecessary for the alpinists or tourists to hold the bottle or can when going ahead.

In summary, the assembly of beverage bottle/can and cup of the present invention is a novel breakthrough of inventive design which has distinguished itself by its considerable practicability, convenience, function and advance in comparison with the conventional one. Therefore, the present invention is innovative, useful and patentable.

I claim:

1. A drinking cup adapted for insertion onto the lower end portion of a factory-sealed beverage container, wherein said container includes an annular cylindrical side wall having a smooth uninterrupted outer surface;

said drinking cup comprising a cylindrical side wall defining a cup axis, said side wall having a plural number of axially-spaced projections (21) extending circumferentially along its inner surface for frictional gripment of the beverage container side wall outer surface, whereby the cup is frictionally adherred to the beverage container; each circumferentially-extending projection having a number of air vent grooves (22) extending therethrough, whereby the cup interior space is in open communication with the ambient atmosphere when the cup is inserted onto a beverage container.

2. The drinking cup of claim 1 and further comprising a clip (23) extending outwardly and then downwardly from the cup side wall; said clip extending circumferentially around the cup at least one fourth of the cup circumferential dimension.

* * * * *